US006125862A

United States Patent [19]

Ishikawa et al.

[11] Patent Number: 6,125,862

[45] Date of Patent: Oct. 3, 2000

[54] CLEANING APPARATUS

[75] Inventors: Masayuki Ishikawa; Shin-ichi Niwa; Mitsuharu Iwamoto, all of Nagano, Japan

[73] Assignee: Sankyo Seiki Mfg. Co., Ltd., Nagano-ken, Japan

[21] Appl. No.: 08/942,019

[22] Filed: Oct. 1, 1997

Related U.S. Application Data

[60] Provisional application No. 60/027,433, Oct. 2, 1996.

[51] Int. Cl.[7] ..... B08B 3/02

[52] U.S. Cl. ..... 134/63; 134/66; 134/105; 134/95.2

[58] Field of Search ..... 134/66, 67, 105, 134/106, 95.2, 102.3, 63

[56] References Cited

U.S. PATENT DOCUMENTS

| | | | |
|---|---|---|---|
| 3,175,299 | 3/1965 | Boucher . | |
| 3,557,466 | 1/1971 | Bodine . | |
| 3,733,710 | 5/1973 | Kearney | 34/9 |
| 4,022,638 | 5/1977 | Weet | 134/1 |
| 4,076,779 | 2/1978 | Skriletz | 264/39 |
| 4,407,036 | 10/1983 | Kuhl | 15/3.13 |
| 4,436,104 | 3/1984 | Kashiwagi | 134/63 |
| 4,723,377 | 2/1988 | Watts | 51/411 |
| 4,808,427 | 2/1989 | Melvin | 426/521 |
| 4,899,768 | 2/1990 | Yatabe | 134/66 |
| 4,985,722 | 1/1991 | Ushijima | 354/319 |
| 5,045,120 | 9/1991 | Mittag | 134/26 |
| 5,113,882 | 5/1992 | Gileta | 134/19 |
| 5,152,605 | 10/1992 | Yamada | 366/148 |
| 5,256,290 | 10/1993 | Becker | 210/400 |
| 5,404,894 | 4/1995 | Shiraiwa | 134/66 |
| 5,423,131 | 6/1995 | Shibano | 34/105 |
| 5,425,308 | 6/1995 | Dickerson | 99/536 |
| 5,517,906 | 5/1996 | Zittel | 99/536 |
| 5,676,761 | 10/1997 | Gormanos | 134/6 |

*Primary Examiner*—Frankie L. Stinson
*Attorney, Agent, or Firm*—Reed Smith Shaw & McClay LLP

[57] ABSTRACT

Cleaning apparatus provide for the cleaning of a workpiece by first immersing the workpiece in a cleaning tank having a cleaning liquid therein for a predetermined period of time, removing the workpiece from the cleaning tank, moving the workpiece through air for a pre-selected period of time, and supplying the workpiece to a drying device which then dries the workpiece. As the workpiece is moved through the air, the workpiece may be vibrated, moved at an incline then a decline, and/or have air blasted at it, so that any liquid, e.g. rinsing solution, remaining thereon is caused to fall off, such occurring prior to the drying of the workpiece by the drying device.

8 Claims, 2 Drawing Sheets

CLEANING APPARATUS

RELATED APPLICATION

This application claims the benefit of U.S. Provisional Application No. 60/027,433 filed Oct. 2, 1996.

BACKGROUND OF THE INVENTION a) Field of the Invention

This invention relates to a cleaning apparatus which washes deposits off the surface of a workpiece.

b) Description of the Related Art

When cutting metallic materials to be finished in a predetermined form, it is common that a cutting fluid is supplied to the workpiece surface between a metallic material and a cutting blade at all times to cool off the heat generated during cutting to increase the cutting performance. Then, the workpiece which has gone through the cutting process is sent to a cleaning apparatus, as illustrated in FIG. 3, to remove the cutting liquid or cutting waste deposited on the workpiece.

As illustrated in FIG. 3, the workpieces which went through the cutting process are held in a plurality of baskets (1) hanging on a conveyor (4) at almost an equal distance from each other. The conveyor (4) transports the plurality of baskets (1) while it repeats an up-down and a one-way operational movement at predetermined times. Under the conveyor (4), a cleaning apparatus (3) having a plurality of tanks (3*a*) to (3*g*) are installed. The cleaning apparatus (3) is comprised of a cleaning liquid tank (3*a*), rinsing tanks (3*b*) to (3*e*), and drying tanks (3*f*) to (3*g*) in that order along the movement of the conveyor (4). A cleaning liquid such as a mild detergent is held in a cleaning liquid tank (3*a*), which removes the lubricant liquid deposited on the workpieces (2). The workpieces (2), which are soaked into the cleaning liquid tank (3*a*) for a predetermined time, are sent to rinsing tanks (3*b*) to (3*e*) which are divided into several steps, each of which contains a rinsing liquid. The workpieces (2) which have gone through the rinsing tanks (3*b*) to (3*e*) are sent to drying tanks (3*f*) to (3*g*) which are arranged adjacent and where the rinsing liquid is heated for evaporation. The deposits on the workpieces (2) deposited during machining are removed while the workpieces go through each tank from (3*a*) to (3*g*) of the cleaning apparatus (3). The resulting workpieces (2) are then used in downstream processes.

However, the aforementioned cleaning apparatus of the related art is configured so that each of the tanks (3*a*) to (3*g*) are arranged at an equal distance and the workpieces (2) go through each of the tanks (3*a*) to (3*g*) held in a cleaning basket (1) for a predetermined time, therefore, the workpieces (2) still having deposited rinsing liquid are sent to the drying tank (3*f*); if the rinsing liquid is pure, the liquid evaporates leaving almost no spots on the workpieces (2); however, if the rinsing liquid contains impurities, the impurities generate spots on the workpieces (2) as illustrated in FIG. 4.

The workpieces (2) having such spots (5) are considered defects in a visual inspection, demanding removal of these spots. In addition, when the workpieces (2) having these spots are used as a component for a hard disk driving motor such as a magnetic disk driving system, the particles which constitute the spots (5) peel off while the motor rotates, to enter between the disk and the magnetic head, possibly triggering damage to the magnetic head or causing recording/reproducing errors.

OBJECT OF THE INVENTION

This invention intends to provide a solution to the problems of the prior art and to provide a cleaning apparatus with which no spots are generated on workpieces after cleaning.

The details of this invention are described herein referring to the drawings.

SUMMARY OF THE INVENTION

In accordance with an embodiment of the present invention, cleaning apparatus and corresponding method are provided for immersing a workpiece to be cleaned in a cleaning tank having a cleaning liquid therein for a predetermined period of time, removing the workpiece from the cleaning tank, moving the workpiece through air for a pre-selected period of time, and supplying the workpiece to a drying device which then dries the workpiece.

As one aspect of the present invention, the workpiece is vibrated as it is moved through the air so that any liquid remaining thereon will fall off. As another aspect, air is blasted at the workpiece as it is moved through the air. As a further aspect, the workpiece is moved at an incline and then at a decline as it is moved through the air.

As an additional aspect of the present invention, the workpiece after being cleaned in the cleaning liquid is rinsed in a rinsing solution, and the workpiece is moved through the air prior to be dried, for a period of time substantially between three minutes and five minutes, so that any rinsing solution remaining on the workpiece is given time to drop off the workpiece.

BRIEF DESCRIPTION OF THE DRAWINGS

In the drawings:

FIG. 2(*a*) illustrates apparatus equipped with an air blasting means; FIG. 2(*b*) equipped with an inclining means;

DESCRIPTION OF THE PREFERRED EMBODIMENTS

Figure 1:
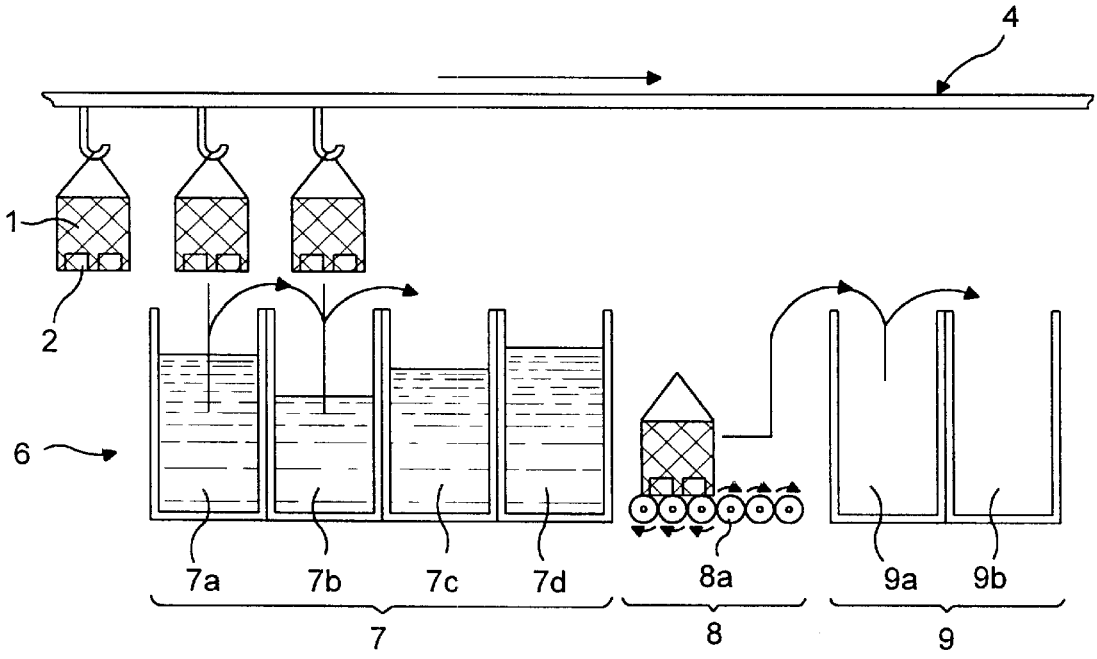
FIG. 1 is a diagram illustrating an embodiment of the cleaning apparatus of this invention.

FIG. 1 illustrates an embodiment of the cleaning apparatus of this invention. In this figure, the cleaning apparatus (6) comprises a cleaning tank (7) holding the liquid for cleaning cutting liquid or cutting waste deposited onto the workpieces (2) or particles ( dust) generated by ionic reactions, a carrier (8) for transferring the workpieces (2) in air which have gone through the cleaning tanks for a predetermined time, and a drying tank (9) for heating the workpieces (2) to remove the solution left on the workpieces (2).

In the cleaning tank (7), a cleaning liquid tank (7*a*) is arranged at the position at which the cleaning step occurs and a basket (1) containing workpieces (2) carried by the conveyor (4) first goes through, while a plurality of rinsing tanks(7*b*) to (7*d*) are arranged following the cleaning tank (7*a*) step. A cleaning liquid such as a mild detergent is held in the cleaning tank (7*a*) and a rinsing liquid such as pure water is held in the rinsing tanks (7*b*) to (7*d*).

Regarding the cutting liquid used for a cutting process, an oil type cutting fluid or a water soluble cutting fluid may be used; however, when the oil type cutting fluid is used, it is comparatively difficult to wash off. Also, under the recent trend toward global environmental protection, the use of fluoride cleaning liquids will be banned completely. Substitute cleaning liquids such as methylene chloride or triclene may be used. However, compared to fluoride cleaning liquids, these liquids are inferior in cleaning efficiency and the effect of these solvents on a human body is also controversial, providing the situation that one may not be able to continue using them in future. To resolve this situation, there is an increasing number of processes which use a water soluble cutting liquid for cutting and a mild detergent for cleaning.

Regarding the liquid held in the rinsing tanks (7*b*) to (7*d*), a water soluble rinsing liquid such as pure water is used because a mild detergent is used for a cleaning liquid in the previous step. Because the rinsing tank consists of several steps, cleaning liquid or spots deposited on workpieces can be removed excellently.

A carrier (8) is provided as the next step to the cleaning tank (7). The carrier has a plurality of rollers (8*a*) rotating in the same direction and transfer the cleaning baskets (1) loaded on the rollers (8*a*) to the drying tank (9) in the next step. The cleaning basket (1) holding the workpieces (2) moves via the carrier (8) in air at normal temperature for a predetermined time; during that time the rinsing liquid deposited on the workpieces (2) in the aforementioned rinsing tank (7*b*) is naturally dried. Note that the carrier (8) can be a belt conveyor with the belt provided motion by the rollers at both ends.

A drying tank (9) is installed as the next step after the carrier (8). The drying tank (9) comprises an air blasting tank (9*a*) which blast air against the workpieces (2) and a heating tank (9*b*) which heats the workpieces (2). In the air blasting tank (9*a*), most of the deposited substances such as water or dust are swept away; water on the workpieces (2) is evaporated by heating, for example, at about 70° C. Then, the workpieces which went through the heating tank are delivered to the next step which is an assembly step and the like.

Next, the cleaning operation using the cleaning apparatus of this invention is described.

A conveyor (4) from which cleaning baskets (1) holding the workpieces (2) hung at an almost equal distance from each other automatically lowers the cleaning baskets (1) into the cleaning liquid tank (7*a*) to soak. The soaking time is about two minutes. Ultrasonic vibration can be applied to the cleaning tank (7*a*) during soaking to increase the cleaning performance.

After a predetermined time has passed, the conveyor (4) rises to take the cleaning baskets (1) out of the cleaning liquid tank (7*a*) and moves the cleaning baskets toward the next step. The conveyor stops moving above the rinsing tank (7*b*) in the following step, lowering the cleaning baskets (1) to have them soak into the rinsing tank (7*b*). The time required for having the baskets taken out of the cleaning liquid tank (7*a*) and soaked into the rinsing tank (7*b*) is about 30 seconds.

During the same operation, the cleaning baskets (1) holding the workpieces (2) are loaded onto the carrier (8) after the rinsing tanks (7*c*) and (7*d*). The carrier (8) transfers the cleaning basket (1) via the rollers (8*a*) to the drying tank (9) of the next step. In other words, the cleaning tank (7) and the drying tank (9) are arranged at a distance and the carrier (8) is installed between them. The workpieces contained in the cleaning baskets are transferred in air for about three to five minutes via the carrier (8), during that time the rinsing liquid deposited on the workpieces (2) may drop off or evaporate, decreasing the rinsing liquid remaining on the workpieces (2). To remove the rinsing liquid deposited on the workpieces efficiently, the height for the rollers (8*a*) may be leveled, or the shape of rollers (8*a*) may be non-circular to provide vibration to the cleaning baskets (1) and the workpieces (2) during transferring.

Note that the cleaning baskets may be loaded on the carrier (8) manually or mechanically.

Next, the cleaning baskets (1) transferred via the carrier (8) enter the air blasting tank (9*a*) in the drying tank (9) for about two minutes. A high pressure air is blasted in this air blasting tank (9*a*) so that the deposits such as water deposited on the workpieces (2) can be swept away by the blasting air.

When the rinsing liquid has been reduced on the workpieces (2) by going through the carrier (8) the previous step for a predetermined time and by going through the air blasting tank (9*a*), the workpieces (2) enter the heating tank (9*b*) with almost no deposits on their surfaces.

Preventing spots deposited on the surfaces of the workpieces (2), eliminates the chance of having a defective appearance. In addition when the workpieces are applied to a hard disk driving motor, because there are almost no spots on their surface, spots do not peel off to destroy a magnetic head or cause recording/reproducing errors.

Furthermore, reduced drying time prevents the workpieces from discoloring.

Note that in the cleaning apparatus (6) of this invention, the deposited detergent is rinsed with pure water. Since pure water evaporates in a relatively short time, it evaporates cleanly generating few spots.

Figure 2A:
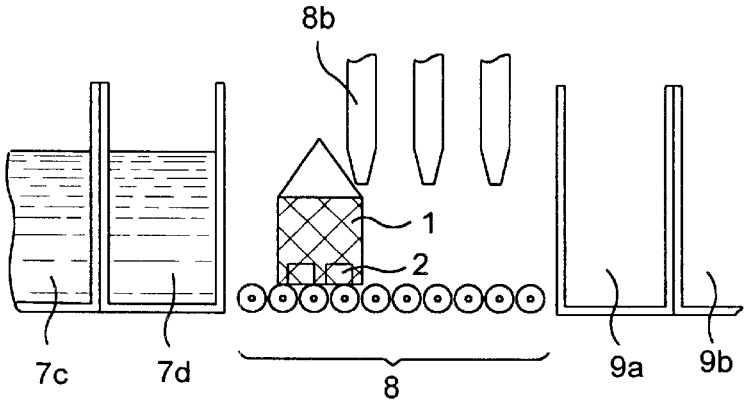
FIGS. 2(*a*) and 2(*b*) are diagrams illustrating another embodiment of the cleaning apparatus of this invention.
Figure 2B:
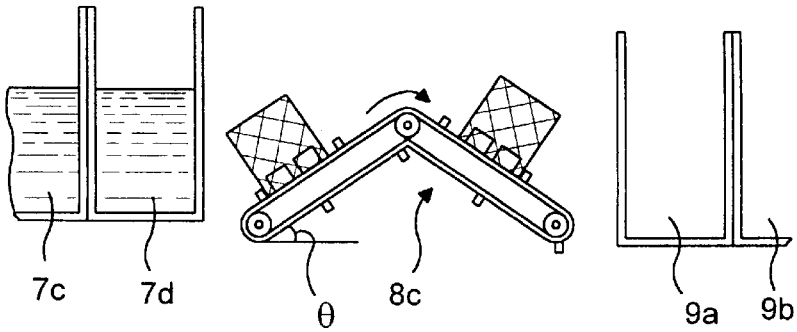
Figure 3:
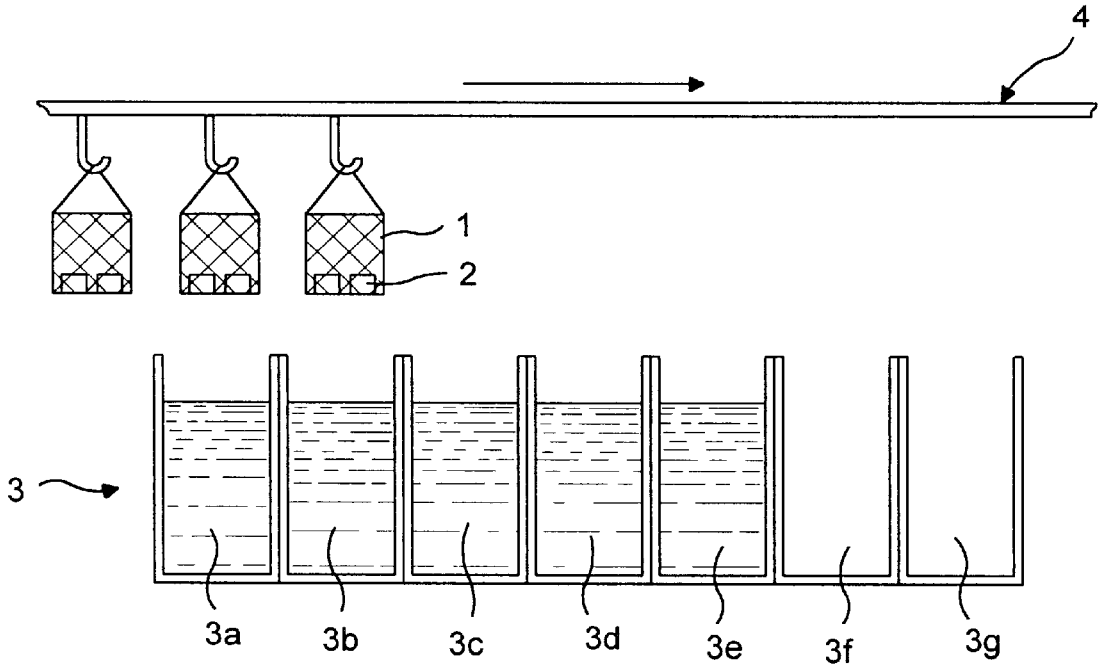
F I G. 3 PRIOR ART
FIG. 3 is a diagram configuration of a conventional cleaning apparatus.
Figure 4:
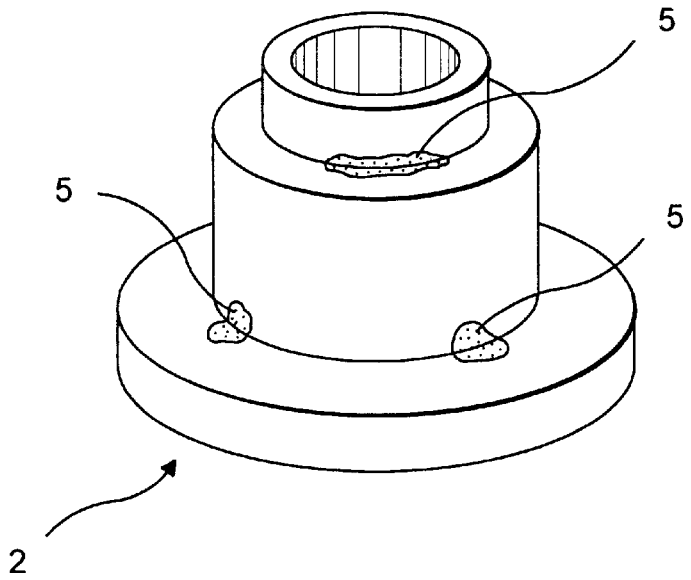
FIG. 4 is a perspective view of a workpiece which is to be cleaned by a cleaning apparatus.

Besides the embodiment described above, one may employ the embodiment illustrated in FIG. 2. In other words, an air blasting means (8*b*) is formed, as illustrated in FIG. (2*a*) so that air is blasted onto the workpieces (2) while the cleaning baskets (1) containing the workpieces (2) are transferred on the carrier (8). An air blasting means can be arranged in the vicinity of the carrier (8) or air can be manually blasted onto the workpieces (2).

Moreover, as illustrated in FIG. 2 (*b*), an inclined surface can be formed as a inclining means (8*c*) on the carrier (8). Loading the cleaning baskets (1) inclines the posture of the cleaning baskets (1) and the workpieces (2). Varying the inclined angle during transferring, the posture of the cleaning baskets (1) and the workpieces (2), much more rinsing liquid deposited to the workpieces (2) can be removed.

In this way, by means of the carrier (8), illustrated in FIG. 2 (*a*) and (*b*), the rinsing liquid and the like is removed faster, no spots are generated on the surfaces of the workpieces (2) when they enter the drying tank (9).

As described, the invention invented by this inventor has been described based on these embodiments. There is no need to say that the invention is not limited to the aforementioned embodiments and a variety of modifications may be made as far as they remain within the spirit of this invention. For example, the apparatus may be configured such that, instead of installing the rollers (8*a*) between the cleaning tank (7) and the drying tank (9) as in the aforementioned embodiments, the cleaning baskets (1) may be hung from the conveyor (4) for a predetermined time and directly enter the drying tank (9). Also the carrier path for the carrier (8) may be U-shaped for reducing the space required for the total cleaning apparatus. Furthermore, the cleaning baskets (1) may be transferred manually in each of the steps without using the conveyor (4).

The workpieces (2) which are the objects to be cleaned may be simple workpiece such as brackets, hubs, or the like. These may also be assembled units, for example, a core wound with a coil and fixed on a bracket.

As described above, according to the cleaning apparatus of this invention, the carrier provided between a cleaning tank and a drying tank for transferring workpieces reduces the rinsing liquid remaining on the workpieces during transfer via the carrier. This prevents the workpieces from being spotted after they have gone through the drying tank.

While the foregoing description and drawings represent the preferred embodiments of the present invention, it will be obvious to those skilled in the art that various changes and modifications may be made therein without departing from the true spirit and scope of the present invention.

What is claimed is:

1. Apparatus for cleaning a workpiece, comprising:

a cleaning tank having a cleaning liquid therein for cleaning an item immersed in the cleaning tank;

workpiece conveyor means for immersing said workpiece in said cleaning tank for a predetermined period of time, and for moving said workpiece through air at a room temperature for a pre-selected period of time sufficient to allow the workpiece to drain said cleaning liquid after said workpiece is cleaned in said cleaning tank; and drying means for drying said workpiece after said workpiece is moved through the air for said pre-selected period of time and is drained of said cleaning liquid, said conveyor means transferring said workpiece to said drying means after said workpiece is moved through the air.

2. The apparatus of claim 1, wherein said drying means is a drying tank including heating means for heating said workpiece transferred to said drying means by said workpiece conveyor means.

3. The apparatus of claim 1, wherein said workpiece conveyor means includes vibrating means for vibrating said workpiece during said period of time said workpiece is moved through the air.

4. The apparatus of claim 1, further comprising means for blasting air at said workpiece during said period of time said workpiece is moved through the air by said workpiece conveyor means.

5. The apparatus of claim 1, wherein said workpiece conveyor means includes a conveyor for moving said workpiece at an incline and then for moving said workpiece at a decline during at least a portion of said period of time said workpiece is moved through the air.

6. The apparatus of claim 1, wherein said cleaning tank includes a plurality of tanks, at least one of said tanks being a washing tank and having said cleaning liquid for cleaning an item immersed therein, and at least another of said tanks being a rinsing tank and having a rinsing solution for rinsing off the cleaning liquid from an item immersed therein; and said workpiece conveyor means is operable to immerse said workpiece in said washing tank and then to immerse said workpiece in said rinsing tank.

7. The apparatus of claim 6, wherein said workpiece conveyor means moves said workpiece through the air for a period of time substantially between three minutes and five minutes so that any rinsing solution remaining on said workpiece is given time to drop off said workpiece.

8. The apparatus of claim 1, wherein said drying means includes blasting means for blasting air at said workpiece and heating means for heating said workpiece after said blasting means blasted air at said workpiece.

* * * * *